US009303851B2

(12) United States Patent
Tachino et al.

(10) Patent No.: US 9,303,851 B2
(45) Date of Patent: Apr. 5, 2016

(54) ILLUMINATION LIGHT SOURCE AND LIGHTING APPARATUS

(71) Applicant: PANASONIC CORPORATION, Osaka (JP)

(72) Inventors: Youji Tachino, Nara (JP); Katsushi Seki, Shiga (JP); Toshio Mori, Hyogo (JP); Nozomu Hashimoto, Osaka (JP); Yukiya Kanazawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 206 days.

(21) Appl. No.: 14/156,506

(22) Filed: Jan. 16, 2014

(65) Prior Publication Data

US 2014/0204560 A1 Jul. 24, 2014

(30) Foreign Application Priority Data

Jan. 22, 2013 (JP) ..... 2013-009611

(51) Int. Cl.

| | |
|---|---|
| ***F21V 23/00*** | (2015.01) |
| ***F21V 21/088*** | (2006.01) |
| ***F21K 99/00*** | (2010.01) |
| ***F21V 19/00*** | (2006.01) |
| *F21Y 101/02* | (2006.01) |

(52) U.S. Cl.

CPC ..... *F21V 21/088* (2013.01); *F21K 9/00* (2013.01); *F21V 19/004* (2013.01); *F21Y 2101/02* (2013.01)

(58) Field of Classification Search

CPC ..... F21K 9/00; F21K 9/30; F21K 9/1375; F21K 9/54

USPC ..... 362/95, 249.02, 249.11

See application file for complete search history.

(56) References Cited

U.S. PATENT DOCUMENTS

| | | | | |
|---|---|---|---|---|
| 8,602,601 | B2 * | 12/2013 | Khazi | F21S 8/026 362/249.02 |
| 8,764,249 | B2 | 7/2014 | Toda et al. | |
| 2011/0075422 | A1 * | 3/2011 | Van De Ven | F21S 8/02 362/249.02 |
| 2012/0182731 | A1 | 7/2012 | Kretschmann et al. | |
| 2012/0243237 | A1 | 9/2012 | Toda et al. | |
| 2013/0201697 | A1 | 8/2013 | Osada et al. | |

FOREIGN PATENT DOCUMENTS

| | | |
|---|---|---|
| CN | 201844360 | 5/2011 |
| CN | 202598185 | 12/2012 |

(Continued)

OTHER PUBLICATIONS

China Office action, dated Jun. 16, 2015 along with an English translation thereof.

(Continued)

*Primary Examiner* — Anabel Ton

(74) *Attorney, Agent, or Firm* — Greenblum & Bernstein, P.L.C.

(57) ABSTRACT

An LED unit which serves as an illumination light source includes: a mounting board on which a light-emitting element, which emits light frontward, is provided; a support disposed behind the mounting board; and a case disposed so that the mounting board is sandwiched in a longitudinal direction by the case and the support. The case includes a restricting portion which restricts sideward movement of the mounting board.

10 Claims, 11 Drawing Sheets

(56) References Cited

FOREIGN PATENT DOCUMENTS

| | | |
|---|---|---|
| CN | 202598186 | 12/2012 |
| DE | 10 2009 055858 | 6/2011 |
| DE | 10 2010 023 497 | 9/2011 |
| DE | 10 2010 041 471 | 3/2012 |
| EP | 2413015 | 2/2012 |
| JP | 2012-204208 | 10/2012 |
| WO | 2012/005239 | 1/2012 |

OTHER PUBLICATIONS

U.S. Appl. No. 14/156,508 to Toshio Mori et al., filed Jan. 16, 2014.
U.S. Appl. No. 14/157,676 to Yukiya Kanazawa et al., filed Jan. 17, 2014.
U.S. Appl. No. 14/156,507 to Nozomu Hashimoto et al., filed Jan. 16, 2014.
Search report from European Search Report, mail date is Apr. 3, 2014.

* cited by examiner

ILLUMINATION LIGHT SOURCE AND LIGHTING APPARATUS

CROSS REFERENCE TO RELATED APPLICATION

The present application is based on and claims priority of Japanese Patent Application No. 2013-009611 filed on Jan. 22, 2013. The entire disclosure of the above-identified application, including the specification, drawings and claims is incorporated herein by reference in its entirety.

FIELD

The present invention relates to an illumination light source using a light-emitting element such as a light-emitting diode (LED) as a light source and to a lighting apparatus including the illumination light source.

BACKGROUND

Conventionally, LED lamps which are disc-shaped or low-profile illumination light sources using LEDs as a light source have been proposed (for example, see Patent Literature (PTL) 1). Generally, such LED lamps include a disk-shaped or low-profile case; and a board on which an LED is mounted, and a support for the placement of the board are disposed inside the case. In addition, the board is secured to the support using a conductive securing component such as a screw, or the like.

CITATION LIST

Patent Literature

[PTL 1] International Publication No. 2012-005239

SUMMARY

Technical Problem

However, with the above-described conventional LED lamp, there is the problem that a securing component such as a screw, or the like, for securing the board to the support is required.

Specifically, when the securing component is required, the configuration of the LED lamp becomes complex, and thus productivity deteriorates and cost increases. Furthermore, since a conductive material is conventionally used for the securing component, a large-sized board is required in order to ensure adequate insulation distance between the securing component and the components on the board.

The present invention is conceived in order to solve the aforementioned problem and has as an object to provide an illumination light source and a lighting apparatus which can be realized without providing a component, such as a screw, or the like, for securing the board to the support.

Solution to Problem

In order to achieve the aforementioned object, an illumination light source according to an aspect of the present invention includes: a board on which a light-emitting element, which emits light frontward, is provided; a support disposed behind the board; and a case disposed so that the board is sandwiched in a longitudinal direction by the case and the support, wherein the case includes a restricting portion which restricts sideward movement of the board.

Furthermore, the restricting portion may include at least a pair of sideward restricting portions disposed at opposite sides of the board so that the board is sandwiched from the sides.

Furthermore, the pair of sideward restricting portions may restrict the sideward movement of the board by exerting pressing force on the board.

Furthermore, when the board is not placed in the case, a tip of one of the pair of sideward restricting portions may be tilted toward an opposing other of the pair of sideward restricting portions.

Furthermore, the board may have an opening, the restricting portion may include an inserting portion which is inserted into the opening, and the inserting portion may restrict the sideward movement of the board by being inserted into the opening.

Furthermore, the restricting portion may further include a backward restricting portion which restricts backward movement of the board.

Furthermore, the restricting portion may further include a forward restricting portion which restricts forward movement of the board.

Furthermore, the forward restricting portion may restrict the forward movement of the board by way of the board being placed thereon.

Furthermore, the restricting portion may be a component having insulating properties.

Furthermore, illumination light source may further include a bonding component disposed between the board and the support and having heat-dissipating properties, for bonding the board and the support.

Furthermore, in order to achieve the aforementioned object, a lighting apparatus according to an aspect of the present invention includes: the above-described illumination light source; and lighting equipment to which the illumination light source is attached, wherein the lighting equipment includes: a main body configured to cover the illumination light source; and a socket attached to the main body, for supplying power to the illumination light source.

Advantageous Effects

The illumination light source and lighting apparatus according to the present invention can be realized without providing a component, such as a screw, or the like, for securing the board to the support.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENTS

Hereinafter, LED units (LED lamps), which serve as the illumination light sources, and a lighting apparatus according to exemplary embodiments of the present invention shall be described with reference to the drawings. It should be noted that each of subsequently-described embodiments show one specific preferred example of the present invention. The numerical values, shapes, materials, structural components, the arrangement and connection of the structural components, etc. shown in the following exemplary embodiments are mere examples, and are not intended to limit the scope of the present invention. Furthermore, among the structural components in the following exemplary embodiments, components not recited in any one of the independent claims are described as arbitrary structural components included in a more preferable form. Moreover, in the respective figures, dimensions, etc. are not precise.

Embodiment 1

First, an outline configuration of an LED unit 1 according to Embodiment 1 of the present invention shall be described.

Figure 1A:
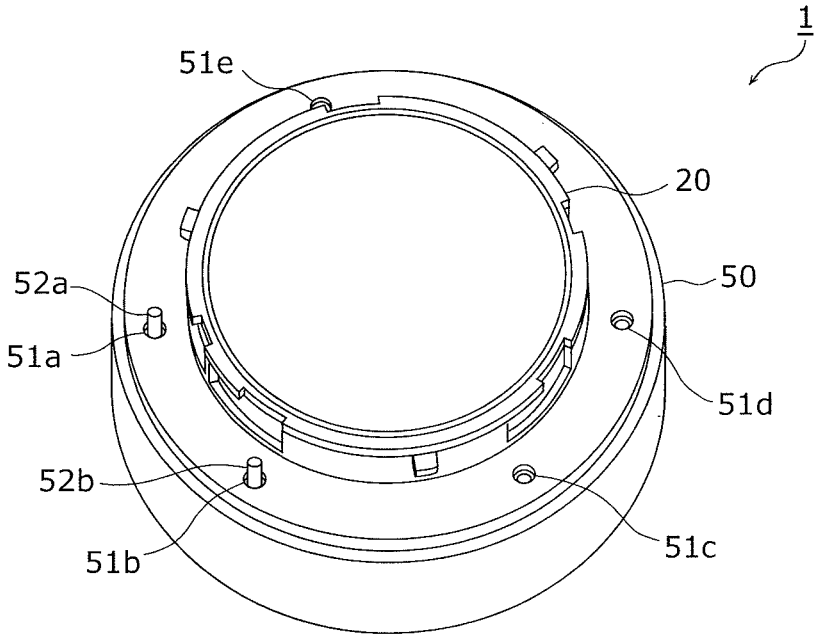
FIG. 1A is a perspective view of an external appearance of an LED unit according to Embodiment 1 of the present invention.
Figure 1B:
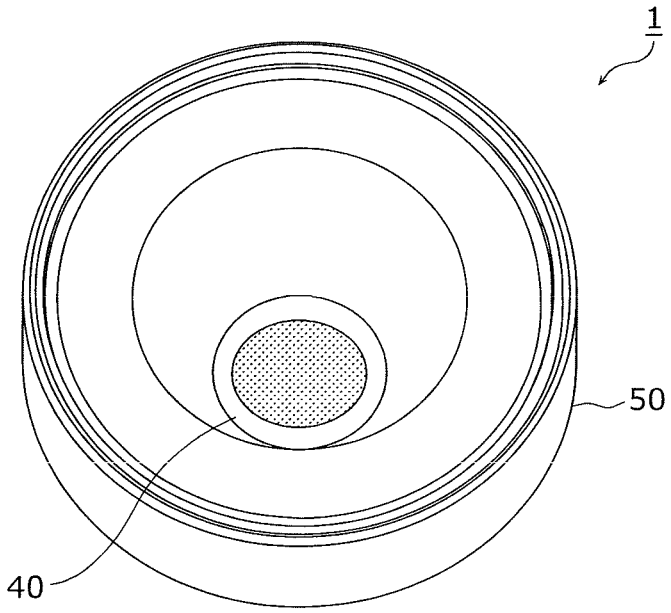
FIG. 1B is a perspective view of an external appearance of the LED unit according to Embodiment 1 of the present invention.

FIG. 1A and FIG. 1B are perspective views of the external appearance of the LED unit 1 according to Embodiment 1 of the present invention. Specifically, FIG. 1A is a perspective view of the LED unit 1 when viewed obliquely from above, and FIG. 1B is a perspective view of the LED unit 1 when viewed obliquely from below. It should be noted that, although an opening of the LED unit 1 is blocked by a cover, the cover is a transparent component and thus the inside of the LED unit 1 can be seen through the cover in FIG. 1B.

Here, in FIG. 1A, the LED unit 1 is illustrated in such a way that the side where light is elicited from the LED unit 1 (hereafter called light-emission side) is the underside, and, in FIG. 1B, the LED unit 1 is illustrated in such a way that the light-emission side is the topside. Hereinafter, description shall be carried out with the light-emission side as the front side (forward), the side opposite the light-emission side as the back side (backward), and a direction crossing the longitudinal (front-back) direction as a sideward direction.

As shown in these figures, the LED unit 1 is an illumination light source having a disk-like or low-profile overall shape. Specifically, the LED unit 1 is an LED lamp having, for example, a GH76p base. More specifically, the LED unit 1 has, for example, an outer diameter of between 50 and 100 mm and a height of between 30 and 50 mm, and when the LED unit 1 is a 20 W LED lamp, the outer diameter is, for example, 90 mm and the height is 45 mm.

Furthermore, the LED unit 1 includes a support 20 that is attached to lighting equipment (not illustrated), a mounting board 40 on which a light-emitting element is provided, and a case 50 that is connected to the support 20.

Furthermore, five through holes 51 (through holes 51*a* to 51*e* in the figure) are formed in a circle in the back side face (face on the lighting equipment side) of the case 50. An electrical connection pin 52 for electrically connecting with the lighting equipment is inserted in each through hole 51. It should be noted that, although electrical connection pins 52*a* and 52*b* are inserted through the through holes 51*a* and 51*b* in the figure, electrical connection pins 52*c* to 52*e* (not illustrated) are also inserted through the through holes 51*c* to 51*e*, respectively.

Here, for example, the electrical connection pins 52*a* and 52*b* are power supply pins, the electrical connection pins 52*c* and 52*d* are light adjustment pins, and the electrical connection pin 52*e* is a grounding pin. It should be noted that, for example, in the case where light adjustment will not be performed, the through holes 51*c* and 51*d* are not formed and the electrical connection pins 52*c* and 52*d* are not inserted. Furthermore, a through hole 51 into which an electrical connection pin 52 is not inserted may be closed, and the through hole 51 need not be formed.

It should be noted that the electrical connections pin 52 of the LED unit 1 are not limited to being provided at the backside of the case 50. For example, the electrical connection pins 52 may be provided at the side of the case 50. In this case, the size of the outer diameter of a heat-dissipating component is not easily restricted by the electrical connection pins 52, and thus the degree of freedom in the design of the heat-dissipating component is improved.

Furthermore, the electrical connection pins 52 are not limited to a rod shape, and may be of another shape such as plate-like, or the like.

Next, the detailed configuration of the LED unit 1 according to Embodiment 1 of the present invention shall be described.

Figure 2:
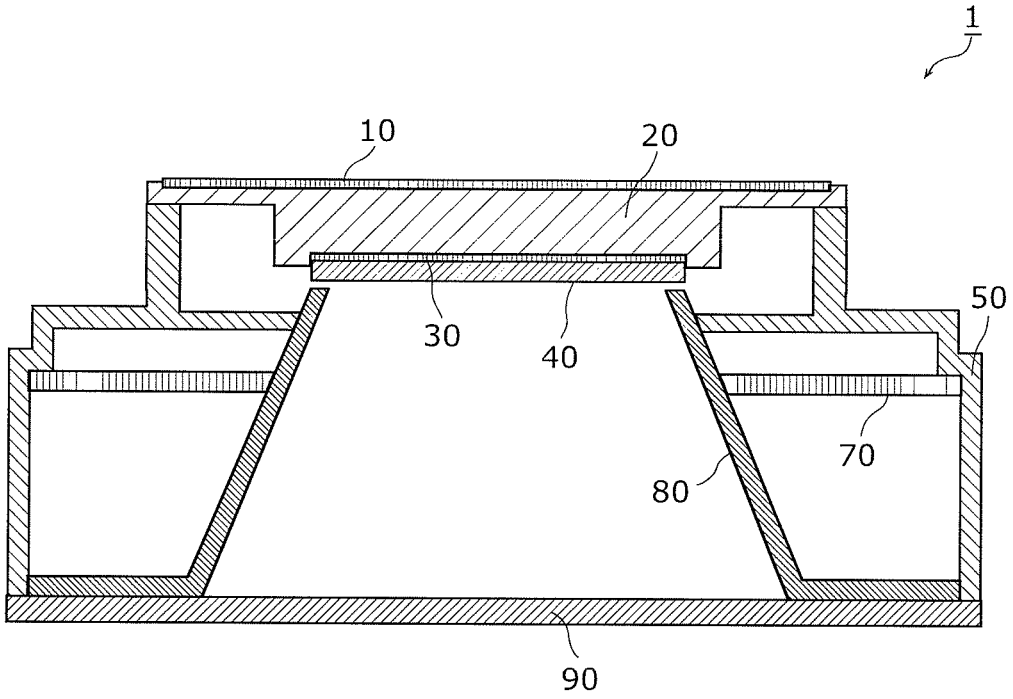
FIG. 2 is a diagram showing a configuration of the LED unit according to Embodiment 1 of the present invention.
Figure 3:
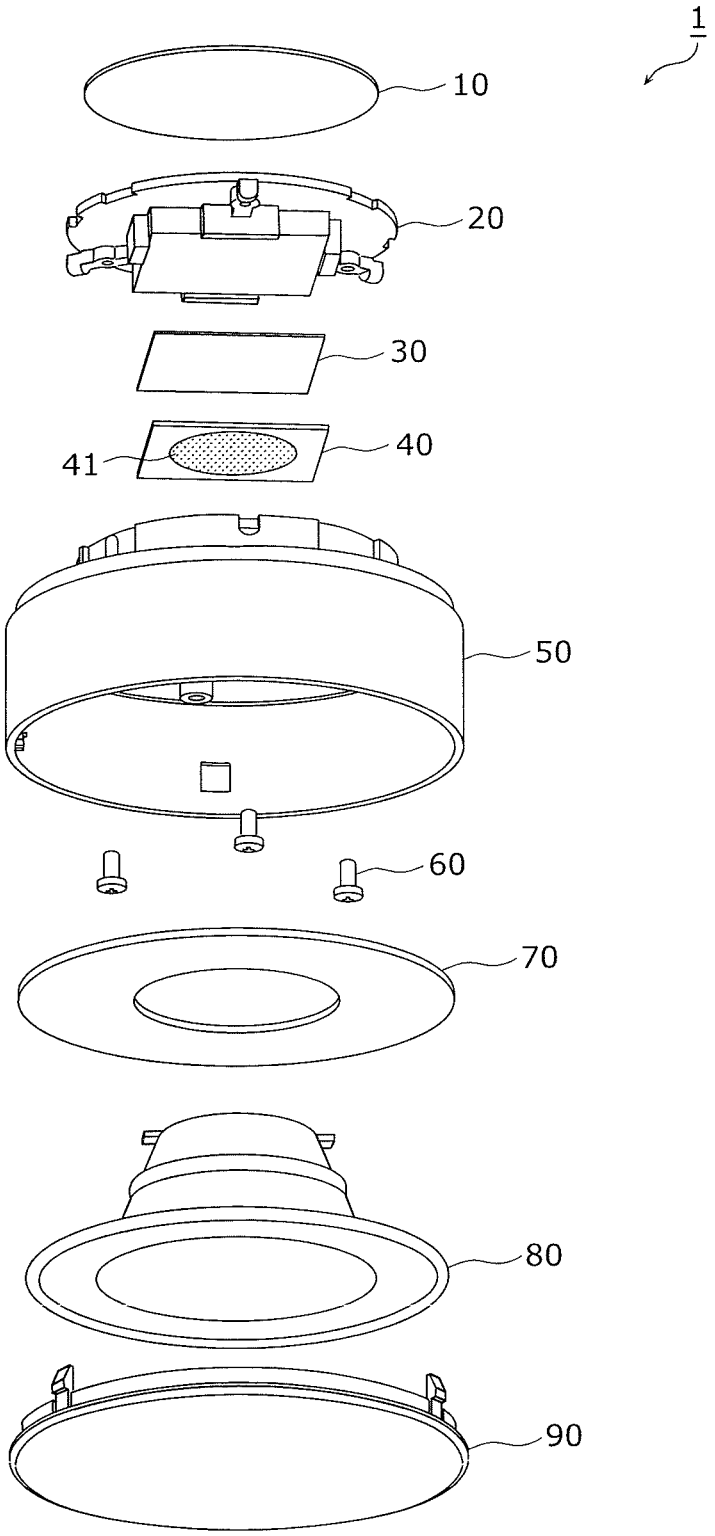
FIG. 3 is a diagram showing the configuration of the LED unit according to Embodiment 1 of the present invention.

FIG. 2 and FIG. 3 are diagrams showing the configuration of the LED unit 1 according to Embodiment 1 of the present invention. Specifically, FIG. 2 is an outline diagram of the cross-section obtained when the LED unit 1 is cut longitudinally, and FIG. 3 is a diagram showing the respective structural components when the LED unit 1 is disassembled.

As shown in these figures, the LED unit 1 includes a heat-conducting sheet 10, the support 20, a heat-conducting sheet 30, the mounting board 40, the case 50, securing screws 60, a circuit board 70, a reflecting mirror 80, and a translucent cover 90.

The heat-conducting sheet 10 is a heat-conductive sheet disposed on the back face of the support 20, for releasing, to the lighting equipment side, the heat from the mounting board 40 that is transmitted via the support 20. Specifically, the heat-conducting sheet 10 is a sheet made of rubber or resin, and is, for example, a silicon sheet or an acrylic sheet.

The support 20 is a component that is connected to the lighting equipment. Specifically, for example, a GH76p base structure is formed in the back portion of the support 20, and is attached and secured to the lighting equipment. Furthermore, the support 20 is a pedestal on which the mounting board 40 is attached, and is disposed on a side opposite (behind) the light-emission side of the mounting board 40. Furthermore, it is preferable that the support 20 be made of highly heat-conductive material such as aluminum. In other words, the support 20 plays the role of a heat sink which dissipates the heat of the mounting board 40.

The heat-conducting sheet 30 is a heat-conductive sheet that thermally connects the mounting board 40 and the support 20. Specifically, the heat-conducting sheet 30 is a heat-conductive sheet that can efficiently transmit the heat from the mounting board 40 to the support 20, and release the heat to the lighting equipment side. It should be noted that, in the case where the mounting board 40 is a metal board, it is preferable that the heat-conducting sheet 30 be an insulating sheet that provides insulation between the mounting board 40 and the support 20. Specifically, the heat-conducting sheet 30 is a sheet made of rubber or resin, and is, for example, a silicon sheet or an acrylic sheet.

Moreover, the heat-conducting sheet 30 may be a liquid component, and so on, such as grease. Here, when the heat-conducting sheet 30 is a liquid component, it is preferable that the heat-conducting sheet 30 be a bonding component such as an adhesive, or the like, having heat-dissipating characteristics. In this manner, by providing, between the mounting board 40 and the support 20, a heat-dissipating bonding component which bonds the mounting board 40 and the support 20, the mounting board 40 can be reliably secured to the support 20, and the heat-dissipating properties from the mounting board 40 to the support 20 can be improved. It should be noted that, for the bonding component, a known heat-dissipating adhesive such as a heat-conductive epoxy adhesive can be arbitrarily used.

The mounting board 40 is disposed inside the case 50 and is a board on which a light-emitting element such as a semiconductor light-emitting element is provided. The mounting board 40 is, for example, configured to be plate-like, and has one face on which the light-emitting element is mounted, and another face that can be thermally connected to the support 20. In other words, the mounting board 40 is disposed between the support 20 and the case 50 so as to be sandwiched in the longitudinal direction by the support 20 and the case 50. Detailed description of the configuration in which the mounting board 40 is sandwiched between the support 20 and the case 50 shall be provided later.

Furthermore, it is preferable that the mounting board 40 be made of highly heat-conductive material, and is, for example, made of an alumina substrate made of alumina. It should be noted that, aside from an alumina substrate, a ceramic substrate made of other ceramic material such as aluminum nitride, metal substrates made of aluminum, copper, or the like, or a metal-core substrate having a stacked structure of a metal plate and a resin substrate may be used for the mounting board 40.

Specifically, a light-emitting unit 41, which has a light-emitting element that emits light toward the front, is provided in the mounting board 40. The light-emitting unit 41 includes one or plural LED chips (not illustrated) mounted on the mounting board 40, and a sealing component (not illustrated). The LED chips are mounted on one of the faces of the mounting board 40 by die bonding, or the like. It should be noted that, for example, blue LED chips which emit blue light having a central wavelength at between 440 and 470 nm are used as the LED chips. Furthermore, the sealing component is a phosphor-containing resin made of a resin containing phosphor, for protecting the LED chips by sealing the LED chips, as well as for converting the wavelength of the light from the LED chips. As a sealing component, for example, in the case where the LED chips are blue light-emitting LEDs, a phosphor-containing resin in which yttrium, aluminum, and garnet (YAG) series yellow phosphor particles are dispersed in silicone resin can be used to obtain white light. With this, white light is emitted from the light-emitting unit 41 (sealing component) due to the yellow light obtained through the wavelength conversion by the phosphor particles and the blue light from the blue LED chips.

Furthermore, the outer diameter of the light-emitting unit 41 is, for example, between 5 and 50 mm, and when the LED unit 1 is a 20 W LED lamp, the outer diameter of the light-emitting unit 41 is, for example, 20 mm.

It should be noted that although a round light-emitting unit 41 is given as an example in this embodiment, the shape or structure of the light-emitting unit in the present invention is not limited to a round one. For example, a square-shaped light-emitting unit may be used. Furthermore, the arrangement of the LED chips is not particularly limited. For example, the LED chips may be sealed in a line, matrix, or circular form.

The case 50 is a longitudinally-short, low-profile (disc-like), cylindrical case surrounding the light-emission side of the LED unit 1. Specifically, each of the front portion and back portion of the case 50 has an opening. The back portion of the case 50 is secured to the support 20 by way of the securing screws 60, and the translucent cover 90 is attached to the front portion of the case 50. In addition, the heat-conducting sheet 30, the mounting board 40, the circuit board 70, and the reflecting mirror 80 are disposed inside the case 50. The case 50 is configured of a resin case made of a synthetic resin having insulating properties, such as polybutylene terephthalate (PBT).

Furthermore, as shown in FIG. 1A, the case 50 includes the electrical connection pins 52 which are power receiving units that receive power for causing the LED chip mounted on the mounting board 40 to emit light. Specifically, the electrical connection pins 52 for supplying power receive alternating-current (AC) power, and the received AC power is input to the circuit board 70 via a lead wire. Detailed description of the configuration of the case 50 shall be provided later.

The securing screws 60 are screws for securing the case 50 to the support 20. It should be noted the case 50 and the support 20 are not limited to being secured using screws. For example, the case 50 and the support 20 may have interfitting regions, and the case 50 may be connected to the support 20 through the interfitting of these regions. Alternatively, the case 50 may be joined to the support 20 by using an adhesive.

The circuit board 70 is disposed inside the case 50, and is a circuit board provided in a drive circuit for driving the light-emitting element. Here, the drive circuit is configured of the circuit board 70 and plural circuit elements (electronic components) mounted on the circuit board 70. In other words, the drive circuit and the light-emitting element are electrically connected by lead wires, and the circuit board 70 causes the light-emitting element to emit light, stop emitting light, or modulate light emission, according to the drive circuit.

Specifically, the circuit board 70 is disposed laterally to the light-emitting unit 41 when the LED unit 1 is viewed from the front (light-emission side), and is a power source circuit board having a circuit element for causing the light-emitting element of the light-emitting unit 41 to emit light. The circuit board 70 is a disk-shaped board in which a circular opening is formed (i.e., donut-shaped board), and is disposed inside the case 50 and outside the reflecting mirror 80. In addition, the circuit element (electronic component) mounted on the circuit board 70 is disposed in the space inside the case 50 and outside the reflecting mirror 80.

In other words, the circuit board 70 is a printed board on which metal lines are formed by patterning, and electrically connects the circuit elements mounted on the circuit board 70 to each other. In this embodiment, the circuit board 70 is disposed such that its principal surface is oriented orthogonally to the lamp axis. The circuit elements are, for example, various types of capacitors, resistor elements, rectifier circuit elements, coil elements, choke coils (choke transistors), noise filters, diodes, or integrated circuit elements, and so on.

Furthermore, since the circuit board 70 is disposed in the back portion of the inside of the case 50, it is preferable that a large-sized circuit element such as, for example, an electrolytic capacitor, choke coil, or the like, be disposed on the front face side of the circuit board 70. It should be noted that although the circuit board 70 is illustrated in this embodiment in a form that is displaced inside the case 50 and outside the reflecting mirror 80, the placement location is not particularly limited and may be arbitrarily designed.

Moreover, with the form in which the circuit board 70 is disposed inside the case 50 and outside the reflecting mirror 80, it is preferable that a large-sized circuit element be disposed on the outer portion of the circuit board 70. This is because, as shown in FIG. 2, when the reflecting mirror 80 has a shape in which the radius widens towards the front, the space formed in the outer portion of the circuit board 70 is larger than the space formed in the inner portion of the circuit board 70.

Specifically, a circuit element (electronic component), or the like, for converting the AC power received from the electrical connection pins 52 for supplying power into direct-current (DC) power is mounted on the circuit board 70. Specifically, the input unit of the circuit board 70 and the electrical connection pins 52 for supplying power are electrically connected by a lead wire or the like, and the output unit of the circuit board 70 and the light-emitting unit 41 of the mounting board 40 are electrically connected by a lead wire or the like. The DC power obtained from the conversion by the circuit board 70 is supplied to the light-emitting unit 41 via a power supply terminal.

The reflecting mirror 80 is an optical component which is disposed on the light-emission side of the mounting board 40, and reflects light emitted from the light-emitting unit 41. In other words, the reflecting mirror 80 reflects, forward, the light emitted from the light-emitting element of the light-emitting unit 41 provided in the mounting board 40. Specifically, the reflecting mirror 80 is disposed in front of the light-emitting unit 41 and inside the case 50 so as to surround the light-emitting unit 41, and includes a cylindrical portion which is formed to have an inner diameter that gradually increases from the light-emitting unit 41 toward the front.

Furthermore, the reflecting mirror 80 is made of a white synthetic resin material having insulating properties. Although it is preferable that the material of the reflecting mirror 80 be a polycarbonate, it is not limited to polycarbonate. It should be noted that, in order to improve reflectivity, the inner face of the reflecting mirror 80 may be coated with a reflective film.

The translucent cover 90 is a low-profile, flat disk-shaped cylindrical component having a bottom, which is attached to the front face of the case 50 in order to protect the components disposed inside the case 50. The translucent cover 90 is secured to the front face of the case 50 by adhesive, rivets, screws, or the like. Furthermore, the translucent cover 90 is made of a highly translucent synthetic resin material such as polycarbonate so as to allow transmission of the outgoing light emitted from the light-emitting unit 41 provided in the mounting board 40.

It should be noted that paint for promoting light-diffusion may be applied to the inner face of the translucent cover 90. Furthermore, phosphor may be included in the translucent cover 90. In this case, the color of the light emitted from the light-emitting unit 41 can be converted by the translucent cover 90.

Furthermore, bumps and indentations (not illustrated) may be formed on the outer face of the translucent cover 90. In this case, when the LED unit 1 is attached to the lighting equipment, the fingers of a worker catch on to the bumps and indentations to allow manipulation of the LED unit 1, and thus facilitate the attachment work.

Next, the configuration of the case 50 shall be described in detail.

Figure 4:
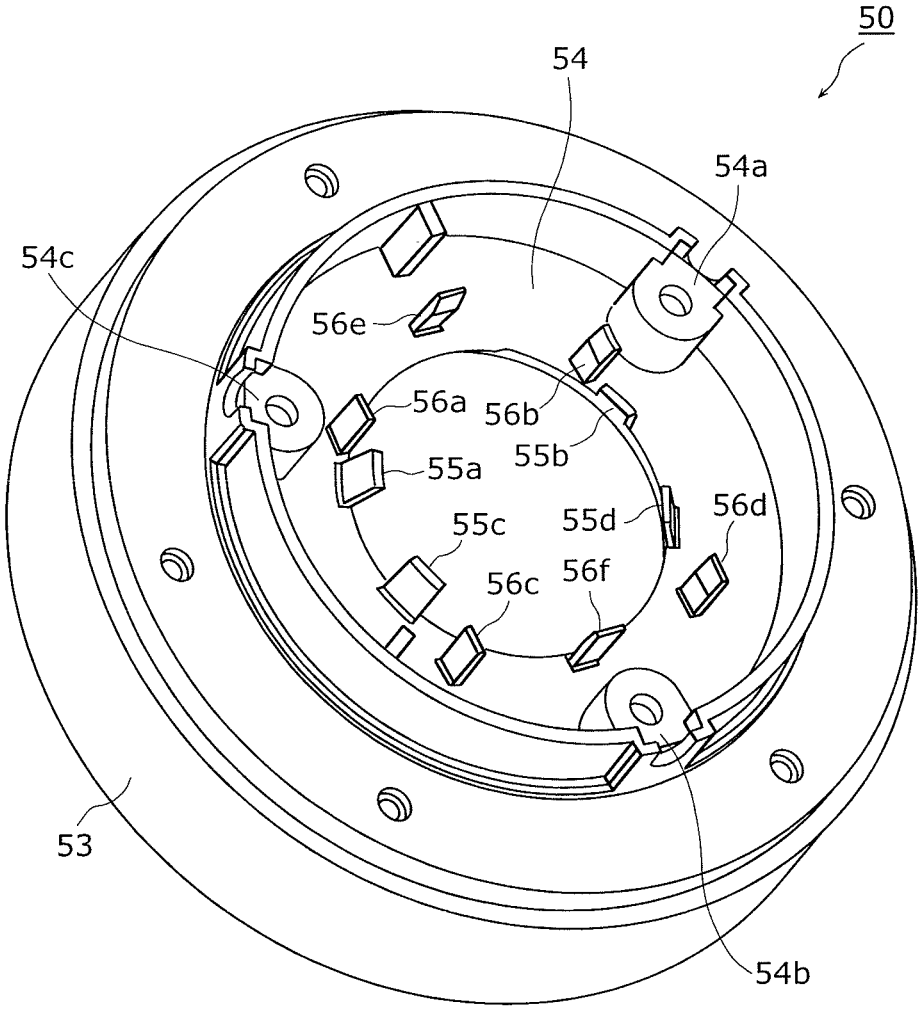
FIG. 4 is a perspective view of a configuration of a case according to Embodiment 1 of the present invention.
Figure 5:
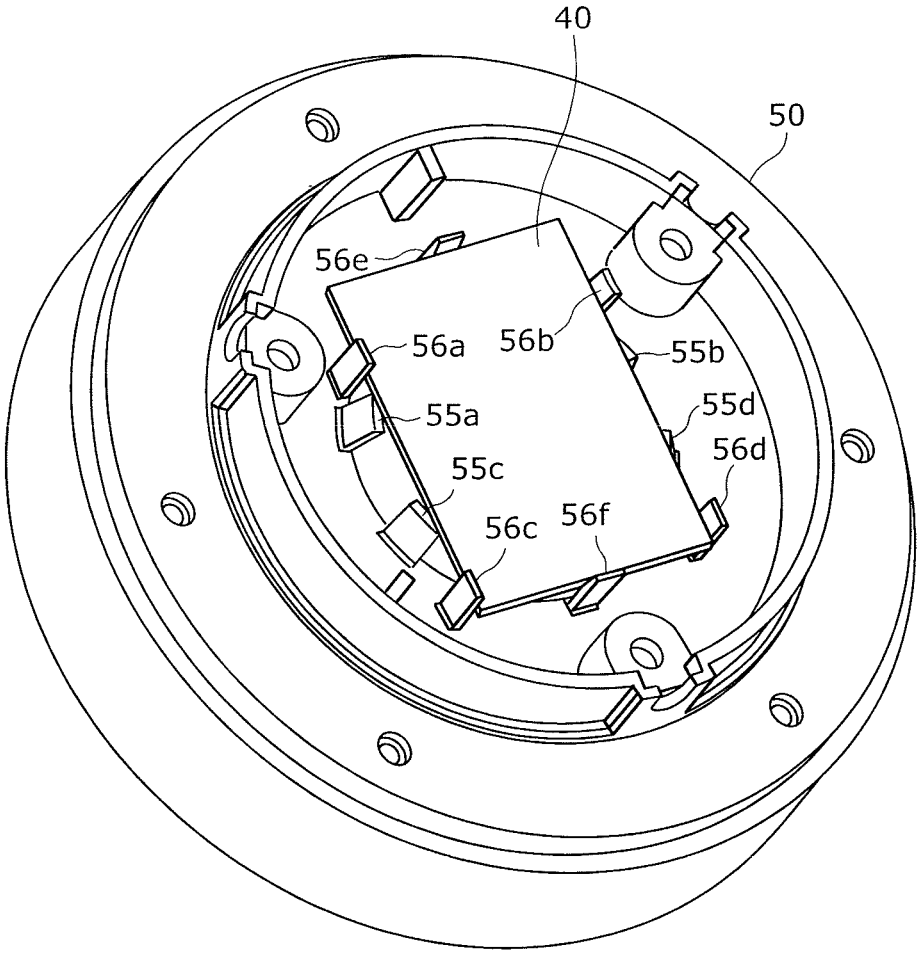
FIG. 5 is a diagram showing a configuration in the state where a mounting board is placed in the case according to Embodiment 1 of the present invention.
Figure 6:
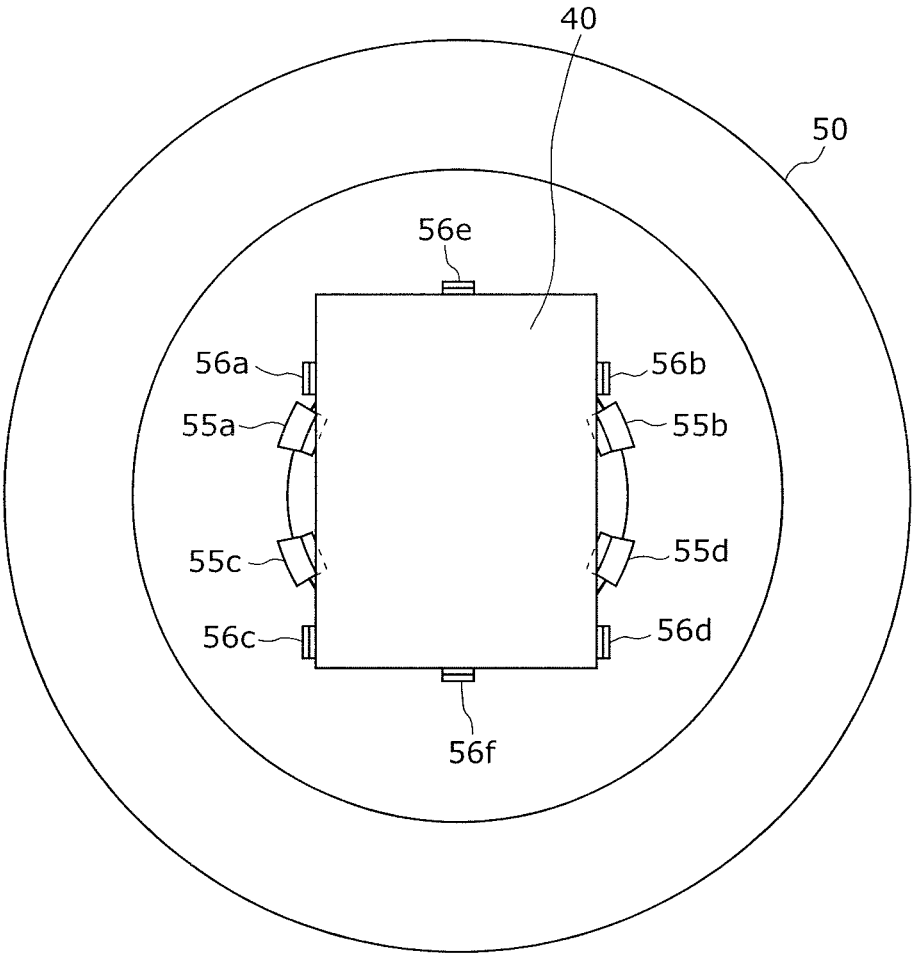
FIG. 6 is a diagram showing a configuration in the state where the mounting board is placed in the case according to Embodiment 1 of the present invention.
Figure 7:
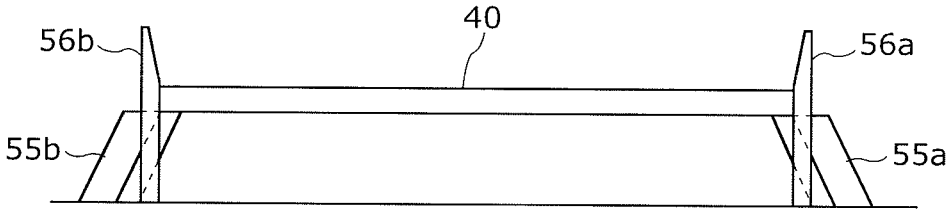
FIG. 7 is a diagram showing a configuration in the state where the mounting board is placed in the case according to Embodiment 1 of the present invention.

FIG. 4 is a perspective view of the configuration of the case 50 according to Embodiment 1 of the present invention. Specifically, the figure is a perspective view of the case 50 as viewed obliquely from behind. Furthermore, FIG. 5 and FIG. 6 are diagrams showing the configuration in the state where the mounting board 40 is placed in the case 50 according to Embodiment 1 of the present invention. Specifically, FIG. 5 is a perspective view of the state where the mounting board 40 is placed in the case 50 as viewed obliquely from behind. Furthermore, FIG. 6 is a plan view of the state shown in FIG. 5 as viewed from behind, and FIG. 7 is a plan view of the state shown in FIG. 5 as viewed from the side (from the top in FIG. 6).

First, as shown in FIG. 4, the case 50 includes an annular case side face 53 and a disk-shaped case top face 54 disposed behind the case side face 53 and having a circular opening formed therein. In other words, the case 50 is formed such that the opening is disposed on the side opposite the support 20.

Screw inserting portions 54*a* to 54*c* for the insertion of the securing screws 60 are formed in the case top face 54. Specifically, three securing screws 60 are respectively inserted in the screw inserting portions 54*a* to 54*c*, and the case 50 and the support 20 are fastened by being screwed together.

Furthermore, the case top face 54 is provided with: a placement portion 55 (placement portions 55*a* to 55*d* in this embodiment) on which the mounting board 40 is placed and which restricts forward movement of the mounting board; and a restricting portion 56 (sideward restricting portions 56*a* to 56*f* in this embodiment) which restricts sideward movement of the mounting board 40. It should be noted that, since the case 50 is formed using a component having insulating properties, the placement portion 55 and the restricting portion 56 are also components having insulating properties.

As shown in FIG. 5 to FIG. 7, the placement portion 55 includes the placement portions 55*a* to 55*d* which are projection-like regions disposed, projecting backward, with respect to the four corners of the mounting board 40, in order to support the four corners of the mounting board 40. Specifically, the placement portions 55*a* to 55*d* are backward-extending plate-like regions provided, at predetermined intervals, in the periphery of the circular opening formed at the center portion of the case top face 54. With this, the placement portions 55*a* to 55*d* restrict the forward movement of the mounting board 40 which has been placed thereon. It should be noted that shape of the placement portions 55*a* to 55*d* is not limited to that of a plate, and may be columnar, and so on.

Furthermore, the placement portion 55 is formed using an elastic component, and presses the mounting board 40 toward the support 20, in the state where the mounting board 40 is sandwiched between the support 20 and the case 50. The mounting board 40 is secured to the support 20 by way of the pressing force of the placement portion 55.

Furthermore, the restricting portion 56 is a projection-like region disposed projecting backward so as to sandwich the mounting board 40 from the sides, and restricts the sideward (in this embodiment, a direction perpendicular to the longitudinal direction of the mounting board 40) movement of the mounting board 40. Specifically, the restricting portion 56 includes at least a pair of sideward restricting portions disposed at the sides of the mounting board 40 to sandwich the mounting board 40 from the sides, and restricts misalignment of the mounting board 40 along the face direction.

In this embodiment, the restricting portion 56 includes the six sideward restricting portions 56*a* to 56*f* (i.e., the sideward restricting portions 56*a* and 56*b*, the sideward restricting portions 56*c* and 56*d*, and the sideward restricting portions 56*e* and 56*f*, which are three pairs of sideward restricting portions). The six sideward restricting portions 56*a* to 56*f* are backward-extending plate-like regions provided at predetermined intervals so as to surround the mounting board 40. It should be noted that the shape of the sideward restricting portions 56*a* to 56*f* is not limited to plates, and may be columnar, and so on.

Specifically, in FIG. 6, the paired sideward restricting portions 56*a* and 56*b* are disposed at the left and right sides of the top portion of the mounting board 40 so as to sandwich the mounting board 40 from the left and right sides of the top portion. Furthermore, the paired sideward restricting portions 56*c* and 56*d* are disposed at the left and right sides of the bottom portion of the mounting board 40 so as to sandwich the mounting board 40 from the left and right sides of the bottom portion. Furthermore, the paired sideward restricting portions 56*e* and 56*f* are disposed above and below the mounting board 40 so as to sandwich the mounting board 40 from above and below. In this manner, the movement of the mounting board 40 in the horizontal direction is restricted by the sideward restricting portions 56*a* and 56*b* and the sideward restricting portions 56*c* and 56*d*, and the movement of the mounting board 40 in the vertical direction is restricted by the sideward restricting portions 56*e* and 56*f*.

Furthermore, the pair of the sideward restricting portions 56*a* and 56*b*, the pair of the sideward restricting portions 56*c* and 56*d*, and the pair of the sideward restricting portions 56*e* and 56*f* restrict the sideward movement of the mounting board 40 by exerting a pressing force on the mounting board 40. Furthermore, the pair of the sideward restricting portions 56*a* and 56*b*, the pair of the sideward restricting portions 56*c* and 56*d*, and the pair of the sideward restricting portions 56*e* and 56*f* are disposed such that, in the state where the mounting board 40 is not placed in the case 50, the tip of one of the sideward restricting portions is tilted toward the opposing other sideward restricting portion. The detailed configuration of the pairs of sideward restricting portions shall be described later.

Figure 8:
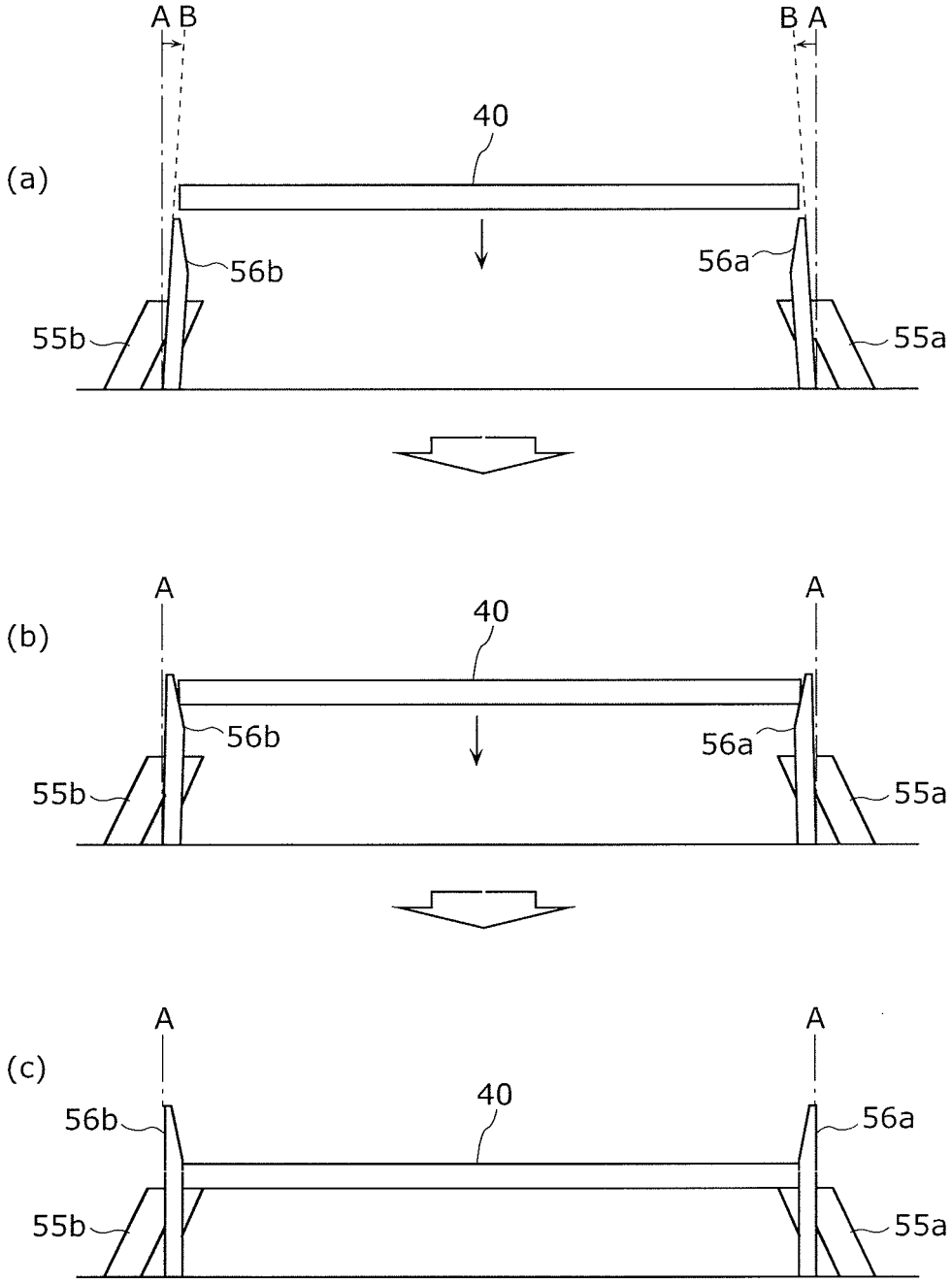
FIG. 8 is diagram showing a detailed configuration of a pair of sideward restricting portions according to Embodiment 1 of the present invention.

FIG. 8 is diagram showing the detailed configuration of the pair of the sideward restricting portions 56*a* and 56*b* according to Embodiment 1 of the present invention. Specifically, the figure is a diagram for describing the steps for placing the mounting board 40 in the case 50. It should be noted that although the example of the pair of the sideward restricting portions 56*a* and 56*b* are described in the figure, the example of the pair of the sideward restricting portions 56*c* and 56*d* and the example of the pair of the sideward restricting portions 56*e* and 56*f* are the same as the example of the pair of the sideward restricting portions 56*a* and 56*b*.

As shown in (a) in the figure, first, the mounting board 40 is placed above the placement portions 55*a* and 55*b* and the pair of the sideward restricting portions 56*a* and 56*b*. Here, the sideward restricting portion 56*a* is disposed so that its tip is tilted toward the sideward restricting portion 56*b*, and the sideward restricting portion 56*b* is disposed so that its tip is tilted toward the sideward restricting portion 56*a*. In short, both the sideward restricting portions 56*a* and 56*b* are disposed tilted from the direction of the straight lines A, which are perpendicular to the case top face 54, to the direction of the straight lines B.

Then, as shown in (b) in the figure, the mounting board 40 is inserted between the pair of the sideward restricting portions 56*a* and 56*b*. With this, both the sideward restricting portions 56*a* and 56*b* are deformed from the direction of the straight lines B toward the direction of the straight lines A, and thus a pressing force which presses toward the mounting board 40 is created in each of the sideward restricting portions 56*a* and 56*b*.

In addition, as shown in (c) in the figure, the mounting board 40 is inserted between the pair of the sideward restricting portions 56*a* and 56*b*, and placed on the placement portions 55*a* and 55*b*. Here, since both of the paired sideward restricting portions 56*a* and 56*b* deform toward the direction of the straight lines A, the pair of the sideward restricting portions 56*a* and 56*b* restrict the sideward movement of the mounting board 40 through a pressing force which presses toward the mounting board 40.

Then, after the mounting board 40 is placed in the case 50, the heat-conducting sheet 30 is disposed behind the mounting board 40, and the support 20 and the case 50 are secured. It should be noted that, as described earlier, by applying a heat-dissipating bonding component on the back face of the mounting board 40 in place of the heat-conducting sheet 30, and sandwiching the mounting board 40 between the support 20 and the case 50, the mounting board 40 can be reliably secured to the support 20, and the heat-dissipating properties from the mounting board 40 to the support 20 can be improved.

As described above, according to the LED unit 1 according to Embodiment 1 of the present invention, the case 50 includes the restricting portion 56 (sideward restricting portions 56*a* to 56*f*) which restricts the sideward movement of the mounting board 40, and the mounting board 40 is sandwiched in the longitudinal direction by the case 50 and the support 20. In other words, the case 50 can secure the mounting board 40 by restricting the sideward movement of the mounting board 40 through the restricting portion 56, and restricting the longitudinal movement of the mounting board 40 together with the support 20. Accordingly, the LED unit 1 can be realized without providing components such as screws for securing the mounting board 40 to the support 20.

It should be noted that, in order to improve the heat-dissipating properties from the mounting board 40, it is preferable that the support 20 be formed using a metal component. However, when a restricting portion such as that described earlier is to be formed in the support 20, the restricting portion is formed using metal, and thus a large-sized mounting board 40 is needed in order to ensure adequate insulation distance between the restricting portion and the components, or the like, on the mounting board 40 As such, because the case 50 includes the restricting portion 56, the mounting board 40 can be secured to the support 20 without increasing the size of the mounting board 40.

Furthermore, the restricting portion 56 includes at least one pair of sideward restricting portions (in this embodiment, the sideward restricting portions 56*a* and 56*b*, the sideward restricting portions 56*c* and 56*d*, and the sideward restricting portions 56*e* and 56*f*, which are three pairs of sideward restricting portions). As such, the sideward movement of the mounting board 40 can be reliably restricted by sandwiching the mounting board 40 from the sides using the pair of sideward restricting portions.

Furthermore, since the pair of the sideward restricting portions restricts the sideward movement of the mounting board 40 by exerting a pressing force on the mounting board 40, the sideward movement of the mounting board 40 can be more reliably restricted.

Furthermore, in the state where the mounting board 40 is not placed in the case 50, the pair of sideward restricting portions are disposed such that the tip of one of the sideward restricting portions is tilted toward the opposing other sideward restricting portion. In this manner, the configuration of the pair of sideward restricting portions is simplified, and the sideward movement of the mounting board 40 can be restricted.

Furthermore, since the restricting portion 56 is a component having insulating properties, it is unnecessary to increase the size of the mounting board 40 to ensure an adequate insulating distance between the restricting portion 56 and the components, or the like, on the mounting board 40.

Modification 1 of Embodiment 1

Next, Modification 1 of Embodiment 1 shall be described. In Embodiment 1, the restricting portion 56 includes the sideward restricting portions 56*a* to 56*f* which restrict the sideward movement of the mounting board 40. However, in this modification, the restricting portion further includes backward restricting portions which restrict the backward movement of the mounting board 40.

Figure 9:
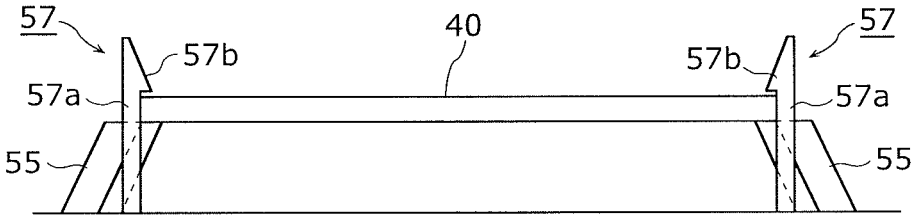
FIG. 9 is a diagram showing a configuration of restricting portions according to Modification 1 of Embodiment 1 of the present invention.

FIG. 9 is a diagram showing a configuration of restricting portions 57 according to Modification 1 of Embodiment 1 of the present invention. Specifically, FIG. 9 is a plan view of the state where the mounting board 40 is placed in a case provided with the restricting portions 57 as viewed from the side.

As shown in the figure, each of the restricting portions 57 includes, in addition to the sideward restricting portion 57*a* which restricts the sideward movement of the mounting board 40, a backward restricting portion 57*b* which restricts the backward movement of the mounting board 40. The backward restricting portions 57*b* are projection-like regions which project toward the opposing restricting portion 57, and restrict the backward movement of the mounting board 40 by way of the front face of the projection-like regions abutting the back face of the mounting board 40.

It should be noted that the sideward restricting portions 57*a* are the same as the sideward restricting portions 56*a* to 56*f* in Embodiment 1, and thus detailed description shall be omitted. Furthermore, other components of the LED unit according to this modification are also the same as those in Embodiment 1, and thus detailed description shall be omitted.

As described above, the LED unit according to Modification 1 of Embodiment 1 of the present invention produces the same advantageous effect as in Embodiment 1 because the restricting portions 57 include the sideward restricting portions 57*a*, and can restrict the backward movement of the mounting board 40 because the restricting portions 57 also include the backward restricting portions 57*b*.

Modification 2 of Embodiment 1

Next, Modification 2 of Embodiment 1 shall be described. In Modification 1 of Embodiment 1, the restricting portions 57 include the sideward restricting portions 57*a* which restrict the sideward movement of the mounting board 40, and the backward restricting portions 57*b* which restrict the backward movement of the mounting board 40. However, in this modification, the restricting portions further include forward restricting portions which restrict the forward movement of the mounting board 40.

Figure 10:
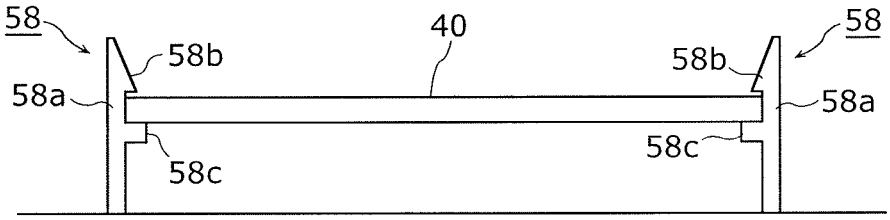
FIG. 10 is a diagram showing a configuration of restricting portions according to Modification 2 of Embodiment 1 of the present invention.

FIG. 10 is a diagram showing a configuration of restricting portions 58 according to Modification 2 of Embodiment 1 of the present invention. Specifically, FIG. 10 is a plan view of the state where the mounting board 40 is placed in a case provided with the restricting portions 58 as viewed from the side.

As shown in the figure, in addition to the sideward restricting portion 58*a*, which restricts the sideward movement of the mounting board 40, and the backward restricting portion 58*b*, which restricts the backward movement of the mounting board 40, each of the restricting portions 58 include, a forward restricting portion 58*c* which restricts the forward movement of the mounting board 40. The forward restricting portions 58*c* are regions which restrict the forward movement of the mounting board 40 through the placement of the mounting board 40 thereon. Specifically, the forward restricting portions 58*c* are projection-like regions which project toward the opposing restricting portion 58, and restrict the forward movement of the mounting board 40 by way of the back face of the projection-like regions abutting the front face of the mounting board 40.

In other words, the case 50 in which the restricting portions 58 is provided, is provided with the forward restricting portions 58*c* which combine the function of restricting the forward movement of the mounting board 40 and the function of having the mounting board 40 placed thereon as with the placement portion 55.

It should be noted that the sideward restricting portions 58*a* and the backward restricting portions 58*b* are the same as the sideward restricting portions 57*a* and the backward restricting portions 57*b* in Modification 1 of Embodiment 1, and thus detailed description shall be omitted. Furthermore, other components of the LED unit according to this modification are also the same as those in Embodiment 1, and thus detailed description shall be omitted.

As described above, the LED unit according to Modification 2 of Embodiment 1 of the present invention produces the same advantageous effect as in Modification 1 of Embodiment 1 because the restricting portions 58 include the sideward restricting portions 58*a* and the backward restricting portions 58*b*, and can restrict the forward movement of the mounting board 40 because the restricting portions 58 also include the forward restricting portions 58*c*. Accordingly, unlike in Embodiment 1 and Modification 1 thereof, the LED unit according to this modification does not need to have the placement units 55. Specifically, since the forward restricting portions 58*c* also have the function of the placement portion 55, the forward restricting portions 58*c* also have the capability to press the mounting board 40 toward the support 20 in the state in which the mounting board 40 is sandwiched between the support 20 and the case. The mounting board 40 can be secured to the support 20 through the pressing force of the forward restricting portions 58*c*.

It should be noted that the restricting portions 58 may be configured not to include the backward restricting portions 58*b*, and only include the sideward restricting portions 58*a* and the forward restricting portions 58*c*.

Modification 3 of Embodiment 1

Next, Modification 3 of Embodiment 1 shall be described. In Embodiment 1, the restricting portion 56 restricts the sideward movement of the mounting board 40 by being disposed at the sides of the mounting board 40 so as to sandwich the mounting board 40. However, in this modification, a restricting portion restricts the sideward movement of the mounting board 40 by being inserted into an opening formed in the mounting board 40.

Figure 11:
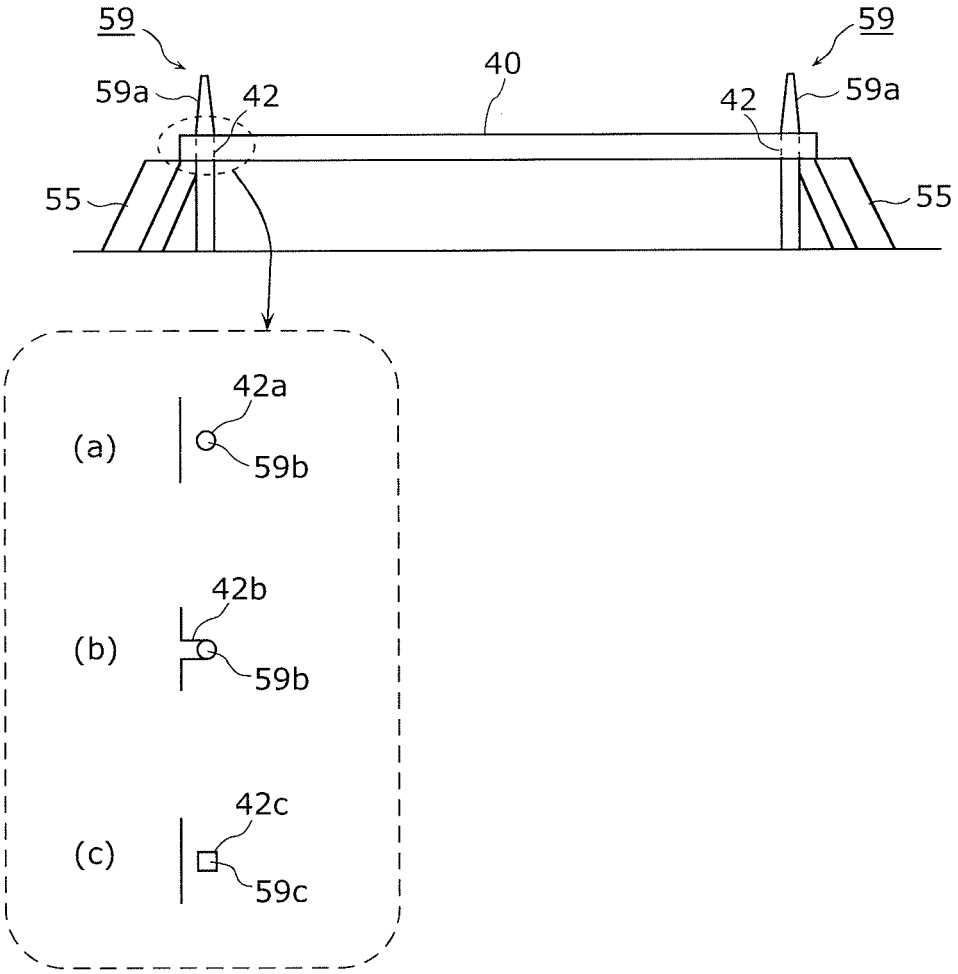
FIG. 11 is a diagram showing a configuration of restricting portions according to Modification 3 of Embodiment 1 of the present invention.

FIG. 11 is a diagram showing the configuration of restricting portions 59 according to Modification 3 of Embodiment 1 of the present invention. Specifically, FIG. 11 is a plan view of the state where the mounting board 40 is placed in a case provided with the restricting portions 59 as viewed from the side.

As shown in the figure, openings 42 are formed in the mounting board 40. Furthermore, each of the restricting portions 59 includes an inserting portion 59*a* which is inserted into the corresponding opening 42. The inserting portion 59*a* is a rod-like component formed to be thinner toward the tip. With this, the inserting portions 59*a* restrict the sideward movement of the mounting board 40 by being inserted into the openings 42.

It should be noted that the shapes of the openings 42 and the inserting portions 59*a* are not particularly limited as long as they are corresponding shapes which fit each other. For example, the opening 42 may be a circular opening 42*a* as shown in (a) in FIG. 11, or may be a cut-out opening 42*b* as shown in (b) in FIG. 11, or may be a rectangular opening 42*c* as shown in (c) in FIG. 11. Furthermore, the inserting portion 59*a* may be an inserting portion 59*b* which is a rod-like component having a circular cross-sectional shape as shown in (a) and (b) in FIG. 11, or may be an inserting portion 59*c* which is a rod-like component having a rectangular cross-sectional shape as shown in (c) in FIG. 11.

Here, when the cross-sectional shape of the inserting portion 59*a* is not circular, such as rectangular and so on, the restricting portion 59 can restrict the rotation of the mounting board 40. For this reason, in such a case, plural restricting portions 59 need not be provided, and it is sufficient to provide a single restricting portion 59 in the LED unit according to this modification.

It should be noted that other components of the LED unit according to this modification are the same as those in Embodiment 1, and thus detailed description shall be omitted.

As described above, according to the LED unit according to Modification 3 of Embodiment 1 of the present invention, the sideward movement of the mounting board 40 can be restricted by way of the inserting portion 59*a* formed in each of the restricting portions 59 being inserted into a corresponding one of the openings 42 formed in the mounting board 40. With this, the sideward movement of the mounting board 40 can be reliably restricted, and thus the same advantageous effects as those in Embodiment 1 can be produced. It should be noted that, the same modification as that in Modification 1 or 2 may be carried out in this modification.

Embodiment 2

Next, a lighting apparatus 100 according to Embodiment 2 of the present invention shall be described.

Figure 12:
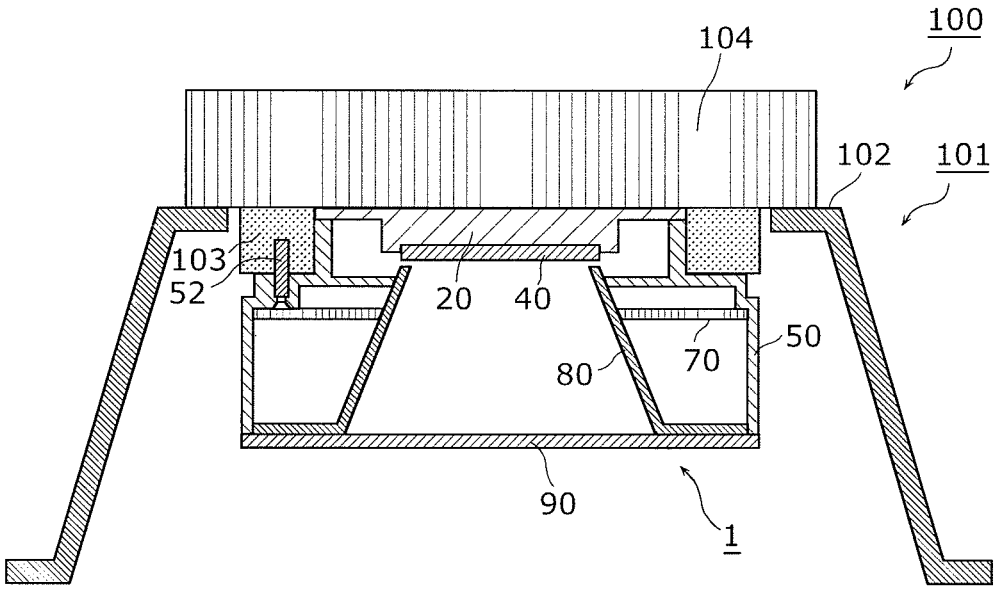
FIG. 12 is a cross-sectional view of a configuration of a lighting apparatus according to Embodiment 2 of the present invention.

FIG. 12 is a cross-sectional view of a configuration of the lighting apparatus 100 according to Embodiment 2 of the present invention. It should be noted that the lighting apparatus according to this embodiment uses the LED unit 1 according to Embodiment 1. Therefore, in the figure, the same reference signs are given to structural components that are the same as the structural components shown in Embodiment 1.

As shown in the figure, the lighting apparatus 100 is, for example, a downlight and includes lighting equipment 101, and the LED unit 1 according to Embodiment 1. The lighting equipment 101 includes: a main body which includes a reflecting plate 102 and a heat-dissipating component 104 and is configured to cover the LED unit 1; and a socket 103 attached to the main body.

The reflecting plate 102 is substantially in the shape of a cup having a circular opening formed on the top face, and is configured so as to laterally surround the LED unit 1. Specifically, the reflecting plate 102 includes: as the top face, a circular flat plate portion in which a circular opening is formed; and a cylinder portion that is formed to have an inner diameter which gradually widens from the periphery of the flat plate portion to the bottom. The cylinder portion has an opening on the light-emission side, and is configured to reflect the light from the LED unit 1. For example, the reflecting plate 102 is made of a white synthetic resin having insulating properties. It should be noted that, in order to improve reflectivity, the inner face of the reflecting plate 102 may be coated with a reflective film. Moreover, the reflecting plate 102 is not limited to a reflecting plate made of synthetic resin, and a metal reflective plate formed from a pressed metal plate may be used.

The socket 103 is compatible with the GH76p base, and is a disk-shaped component that supplies AC power to the LED unit 1. The socket 103 is arranged so that its upper portion is inserted inside the opening formed in the flat plate portion in the top face of the reflecting plate 102. An opening shaped to conform to the shape of the base of the support 20 is formed at the center of the socket 103, and the top face of the LED unit 1 and the bottom face of the heat-dissipating component 104 are thermally connected by installing the LED unit 1 in such opening. Furthermore, a connection hole into which an electrical connection pin 52 is inserted is formed at a position at the bottom portion of the socket 103 which corresponds to the electrical connection pin 52 of the case 50.

The heat-dissipating component 104 is a component which dissipates the heat transmitted from the LED unit 1. The heat-dissipating component 104 is disposed to abut the top face of the reflecting plate 102 and the top face of the socket 103. It is preferable that the heat-dissipating component 104 be made of highly heat-conductive material such as aluminum.

It should be noted that the LED unit 1 is installed in the socket 103 in a removable manner.

As described above, according to the lighting apparatus 100 according to Embodiment 2 of the present invention, the inclusion of the LED unit 1 according to Embodiment 1 makes it possible to produce the same advantageous effects as in Embodiment 1. It should be noted that the same modification as in the foregoing embodiment and modifications may be carried out in this embodiment.

Although LED units, as illumination light sources, and a lighting apparatus according to the embodiments of the present invention and modifications thereof have been described, the present invention is not limited to the above-described embodiments and modifications thereof. Specifically, the embodiments and modifications thereof disclosed herein should be considered, in all points, as examples and are thus not limiting. The scope of the present invention is defined not by the foregoing description but by the Claims, and includes all modifications that have equivalent meaning to and/or are within the scope of the Claims.

Furthermore, forms obtained by arbitrarily combining the above-described embodiments and modifications are also included in the scope of the present invention. Furthermore, the present invention may be configured by arbitrarily combining partial components in the embodiments and modifications thereof.

For example, although the case is a cylindrical component in the above-described embodiments and modifications, the shape of the case is not limited to such. For example, the case may be configured in a polygonal cylinder-shape such as a quadrangular cylinder, a pentagonal cylinder, a hexagonal cylinder, or an octagonal cylinder, or in a truncated cone-shape.

Furthermore, although the heat-conducting sheet 30, the mounting board 40, the circuit board 70, and the reflecting mirror 80 are disposed inside the case in the above-described embodiments and modifications, each of these components may be entirely or partially disposed outside the case.

Furthermore, optical components such as a lens or reflector for focusing the light from the light-emitting unit 41, or optical filters, and the like, for color tone-adjustment may be used in the above-described embodiments and modification. However, such components are not essential components for the present invention.

Furthermore, although the light-emitting unit 41 has a COB-type configuration in which the LED chip is directly mounted on the mounting board 40, the configuration of the light-emitting unit is not limited to such. For example, it is also acceptable to use a surface mounted device (SMD) light-emitting unit configured by using packaged LED elements, in each of which the LED chip is mounted inside a cavity formed using resin and the inside of the cavity is enclosed by a phosphor-containing resin, and mounting a plurality of the LED elements on a board.

Furthermore, although the light-emitting unit 41 is configured to emit white light by using a blue light-emitting LED and yellow phosphor in the foregoing embodiments and modifications, the present invention is not limited to such configuration. For example, it is possible to emit white light by using a phosphor-containing resin which contains red phosphor and green phosphor, and combining such resin with a blue light-emitting LED.

Furthermore, the light-emitting unit 41 may use an LED which emits light of a color other than blue. For example, when using an ultraviolet light-emitting LED chip as the LED, a combination of respective phosphor particles for emitting light of the three primary colors (red, green, blue) can be used as the phosphor particles. In addition, a wavelength converting material other than phosphor particles may be used, and, as a wavelength converting material, it is possible to use a material including a substance which absorbs light of a certain wavelength and emits light of a wavelength different to that of the absorbed light, such as a semiconductor, a metal complex, an organic dye, or a pigment.

Furthermore, although an LED is given as an example of a light-emitting element in the foregoing embodiments and modifications, semiconductor light-emitting elements such as a semiconductor laser, or light-emitting elements such as organic electro luminescence (EL) elements or non-organic EL elements may be used.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

INDUSTRIAL APPLICABILITY

The illumination light source according to the present invention can be widely used as an LED unit (LED lamp), or the like, that includes, for example, a GH76p base.

The invention claimed is:

1. An illumination light source comprising:
a board on which a light-emitting element, which emits light frontward, is provided;
a support disposed behind the board; and
a case disposed so that the board is sandwiched in a longitudinal direction by the case and the support,
wherein the case includes a restricting portion which restricts sideward movement of the board, and
wherein the restricting portion includes at least a pair of sideward restricting portions disposed at opposite sides of the board so that the board is sandwiched from the sides by the pair of sideward restricting portions.

2. The illumination light source according to claim 1,
wherein the pair of sideward restricting portions restrict the sideward movement of the board by exerting pressing force on the board.

3. The illumination light source according to claim 2,
wherein, when the board is not placed in the case, a tip of one of the pair of sideward restricting portions is tilted toward an opposing other of the pair of sideward restricting portions.

4. The illumination light source according to claim 1,
wherein the board has an opening,
the restricting portion includes an inserting portion which is inserted into the opening, and
the inserting portion restricts the sideward movement of the board by being inserted into the opening.

5. The illumination light source according to claim 1,
wherein the restricting portion further includes a backward restricting portion which restricts backward movement of the board.

6. The illumination light source according to claim 1,
wherein the restricting portion further includes a forward restricting portion which restricts forward movement of the board.

7. The illumination light source according to claim 6,
wherein the forward restricting portion restricts the forward movement of the board by way of the board being placed thereon.

8. The illumination light source according to claim 1,
wherein the restricting portion is a component having insulating properties.

9. The illumination light source according to claim 1, further comprising
a bonding component disposed between the board and the support and having heat-dissipating properties, for bonding the board and the support.

10. A lighting apparatus comprising:
the illumination light source according to claim 1; and
lighting equipment to which the illumination light source is attached,
wherein the lighting equipment includes:
a main body configured to cover the illumination light source; and
a socket attached to the main body, for supplying power to the illumination light source.

* * * * *